US009300414B1

(12) United States Patent
Daniel

(10) Patent No.: US 9,300,414 B1
(45) Date of Patent: Mar. 29, 2016

(54) SYSTEM AND METHOD FOR DELIVERING AND RECEIVING MULTIMEDIA CONTENT

(71) Applicant: Isaac S. Daniel, Miramar, FL (US)

(72) Inventor: Isaac S. Daniel, Miramar, FL (US)

( * ) Notice: Subject to any disclaimer, the term of this patent is extended or adjusted under 35 U.S.C. 154(b) by 34 days.

(21) Appl. No.: 14/178,139

(22) Filed: Feb. 11, 2014

Related U.S. Application Data

(60) Provisional application No. 61/763,222, filed on Feb. 11, 2013.

(51) Int. Cl.
*H04H 20/51* (2008.01)
*H04H 20/57* (2008.01)

(52) U.S. Cl.
CPC ..... *H04H 20/51* (2013.01); *H04H 20/57* (2013.01)

(58) Field of Classification Search
CPC .... G08G 5/0013; G08G 5/065; H04W 16/18; H04W 24/00; H04M 1/6091
USPC ..... 455/66.1, 569.2, 423, 406, 414.1
See application file for complete search history.

(56) References Cited

U.S. PATENT DOCUMENTS

2004/0127192 A1* 7/2004 Ceresoli et al. ..... 455/405
2009/0021213 A1* 1/2009 Johnson ..... 320/109
2009/0319341 A1* 12/2009 Berkobin et al. ..... 705/10
2011/0046968 A1* 2/2011 Hawthorne et al. ..... 705/1.1
2012/0144468 A1* 6/2012 Pratt et al. ..... 726/7
2014/0249713 A1* 9/2014 Davis ..... 701/36

OTHER PUBLICATIONS

Sirius A La Carte Gold, Sirius a La Carte, A La Carte Packages, 5 pages regarding subscriptions, retrieved Feb. 11, 2014, http://www.siriusxm.com/subscriptions/packages/sirius/alacarte.

Activating a Radio, SiriusXM Pre-Owned Vehicle Program, 2 pages regarding enrollment/activation, retrieved Feb. 11, 2014, http://www.siriusxm.com/subscriptions/packages/sirius/alacarte.

* cited by examiner

*Primary Examiner* — Minh D Dao
(74) *Attorney, Agent, or Firm* — Alberto Interian, III

(57) ABSTRACT

A system that includes at least one radio service transceiver positioned within a vehicle, wherein the vehicle includes an on-board diagnostic system, a removable unique identification module that is configured to be connected to the vehicle's on-board diagnostic system to deliver media content, including satellite radio services, and specifically radio content, making radio content more accessible by providing a customizable subscription plan to users, a pay per use payment structure, and removable unique identification module that is configured to be connected to a vehicle's on-board diagnostic port.

15 Claims, 3 Drawing Sheets

SYSTEM AND METHOD FOR DELIVERING AND RECEIVING MULTIMEDIA CONTENT

PRIORITY CLAIM

This patent application is a Non-Provisional patent application and claims priority under 35 U.S.C. §119(e) to U.S. Provisional Patent Application Ser. No. 61/763,222, titled "System and Method for Delivering Multimedia Content" filed Feb. 11, 2013. The entire disclosure of the afore-mentioned patent application is incorporated by reference as if fully stated herein.

FIELD OF THE INVENTION

The present disclosure relates generally to electronics systems, and more specifically to the delivery of media content, and specifically radio content.

BACKGROUND OF THE INVENTION

For the majority of its existence, radio content, such as music and talk radio, has been delivered to listeners over traditional modulation broadcasting means, such as AM and FM. Although most FM and AM radio services are provided free of charge, the problem with FM and AM radio is that broadcasters recoup their costs by presenting advertisements in the broadcasts, which listeners may find annoying.

More recently, satellite radio services have become popular amongst listeners, due to their ad-free nature. However, listeners must pay a premium for satellite radio over FM and AM radio, often having to pay hundreds of dollars per year.

Another problem with satellite radio services are their subscription-type payment plans, which cause frustration to travelers, who end up having to pay for services they do not use. Furthermore, another problem with current services occurs when a subscription plan is tied to a receiving device built into a vehicle, such as a car. The reason being that when a user sells the vehicle, they lose the subscription plan tied to the vehicle.

SUMMARY OF THE INVENTION

The various embodiments of systems and methods disclosed herein result from the realization that radio content may be made more accessible by providing a customizable subscription plan to users, a pay per use payment structure, and removable unique identification module that is configured to be connected to a vehicle's on-board diagnostic port.

DETAILED DESCRIPTION OF PREFERRED EMBODIMENTS

Figure 1A:
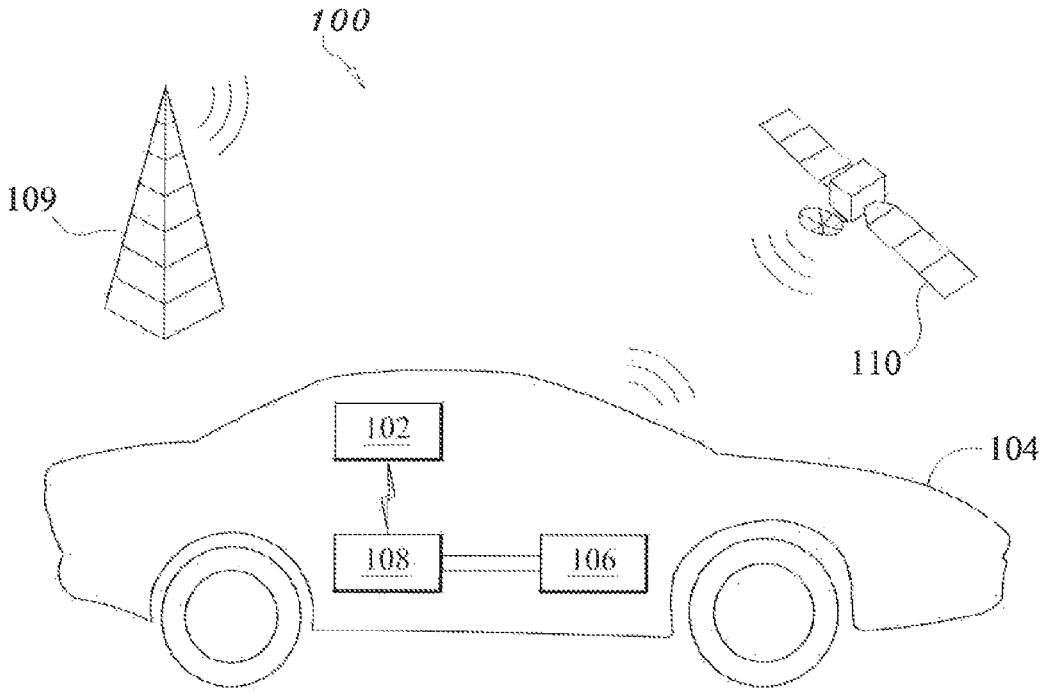
FIG. 1 A shows a system in accordance with one embodiment.
FIG. 1B shows a system in accordance with another embodiment.

FIG. 1A shows a system 100 comprising at least one radio service transceiver 102 positioned within a vehicle 104, wherein vehicle 104 comprises an on-board diagnostic system 106, and a removable unique identification module 108 configured to be connected to vehicle 104's on-board diagnostic system 106, and wherein at least one radio service transceiver 102 may be configured to electronically communicate with removable unique identification module 108.

In some embodiments, radio service transceiver 102 may comprise any type of radio service transceiver, such as, but not limited to, an internet radio service transceiver, a satellite radio service transceiver, a FM or AM radio service transceiver, and the like. Radio service transceiver 102 may be connected to or integrated with vehicle 104's entertainment system, which may include a head unit, amplifiers, speakers, and the like. In an alternate embodiment, radio service transceiver 102 may comprise a stand-alone radio service transceiver. In some embodiments, radio service transceiver 102 may comprise a user input device, such as a button, a touch screen, voice recognition, keypad, joystick, and the like. In another embodiment, radio service transceiver 102 may be configured to transmit an alert, such as an emergency alert, to an emergency service operator or a radio service operator, if at least one of the user input device is used for a predetermined number of times, in a predetermined series, or a predetermined period of time such as by pressing button 1, button 2, then button 3, or by pressing button 1 for a period of five seconds, or by pressing button 1 three times. The user input device may comprise traditional user input device, such as radio buttons, and the like, such that a user may send an alert signal covertly by pressing standard buttons on the radio, which any other person (such as a robber or an assaulter) would not know that the user was sending a cover alert signal.

In another embodiment, radio service transceiver 102 may comprise a means for communicating wirelessly, such an antenna, which may be configured to communicate with long-range devices, such as antenna towers 109 and satellites 110, and/or communicate with short-range devices, such as personal computing and/or communication devices. The communications protocols may comprise short-range and long-range communication protocols, such as BLUETOOTH™, WLAN, ZIGBEE™, GSM, LTE, cellular, WiMAX™, and the like. Radio service transceiver 102 may be configured to receive radio service from a short-range (such as smartphones, which may relay internet radio services or other media, such as content stored locally on the smartphone, to transceiver 102), or from a long-range (such as radio towers and satellites).

In some embodiments, vehicle 104 may comprise any type of vehicle, such as, but not limited to, a motorcycle, scooter, car, truck, van, commercial vehicle, ships, boats, airplanes, hovercrafts, bicycles, and the like.

In some embodiments, on-board diagnostic system ("OBD") 106 may comprise/carry-out various functions and features, such as monitoring vehicle 104's drive systems, entertainment systems, climate control systems, and the like, and may contain or be configured to access information related to vehicle 104, such as date of manufacture, model, brand, vehicle identification number ("VIN"), usage data such as mileage, driving habits, maintenance records, and the like. In some embodiments, on-board diagnostic system 106 may comprise an access port, which may be configured to connect to external devices, such as diagnostic devices, and/or removable unique identification module 108. The VIN number may comprise traditional VIN numbers which are assigned to vehicles by the manufacturer, and which designate place of origin, options, and the like.

Removable unique identification module 108 ("RUIM") may comprise a means for receiving power, such as a connector for receiving power from OBD system 106, which may include a means for receiving power from OBD system 106's access port. In some embodiments, RUIM 108 may comprise a connector (shown as 111 in FIG. 1B) configured to connect to OBD system 106's access port. In some embodiments, RUIM 108 may be configured to connect to and communicate with OBD system 106, and receive, access, or retrieve information contained in OBD system 106. In some embodiments, RUIM 108 may be configured to connect to OBD system 106 either wirelessly, through wired or direct connections, and/or both.

Figure 1B:
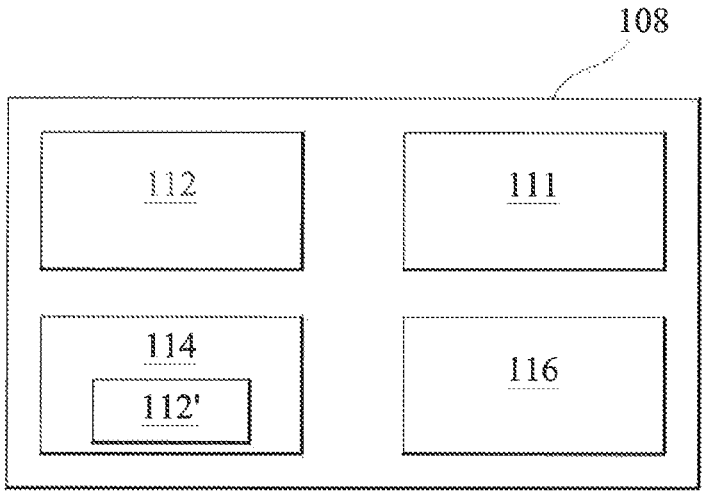

Referring now to FIG. 1B, in some embodiments, RUIM 108 may comprise a unique identifier 112 associated with at least one user account. Unique identifier 112 may comprise a software based unique identifier, such as data or information 112' stored on a computer readable medium. Accordingly, in some embodiments, RUIM 108 may comprise a computer readable medium 114, which may comprise a non-transitory computer readable medium, or a transitory computer readable medium. In other embodiments, unique identifier 112 may comprise a hardware based unique identifier, such as a subscriber identification module ("SIM"). In another embodiment, RUIM 108 may comprise a communications device 116 configured to connect to the at least one radio service transceiver 102, wherein the communications device 116 may comprise a wireless communications module or a wired communications module, such as those embodiments described herein.

In some embodiments, RUIM 108 may be configured to connect to OBD system 106, including OBD system 106 port, and receive a unique identifier associated with vehicle 104. In some embodiments, the unique identifier may comprise unique identifier 112. In some embodiments, the unique identifier may comprise vehicle 104's VIN. RUIM 108 may be configured to be removed from vehicle 104, and connected to a second vehicle, wherein the system 100 may be configured to associate the second vehicle and vehicle 104 with the at least one user account, unique identifiers (e.g. from respective vehicles/RUIMs). The user account may be associated with a user of system 100 (and components thereof).

In some embodiments, RUIM 108 may be configured to transmit unique identifier 112 associated with vehicle 104 to at least one radio service transceiver 102, wherein transmitting may occur wirelessly or via a wired connection. Thereafter, radio service transceiver 102 may be configured to transmit the unique identifier to at least one radio service provider, which may be achieved by using any of the communications means described above. The radio service provider may be configured to associate the unique identifier with vehicle 104, transceiver 102, RUIM 106, a user, and the user account. The radio service provider may comprise a satellite radio service provider, an internet radio service provider, and/or an AM or FM radio service provider, such as radio stations.

In some embodiments, the VIN number and/or the RUIM may be used by a radio service provider to verify or authenticate a user, user account, radio transceiver, RUIM and/or vehicle in for reception of radio services. If an unauthorized user, user account, radio transceiver, RUIM, or vehicle is detected, then the radio services may be declined. This may include determining whether a user, user account, RUIM, radio transceiver, vehicle, or VIN number is associated with an authorized credential or user account.

Figure 2:
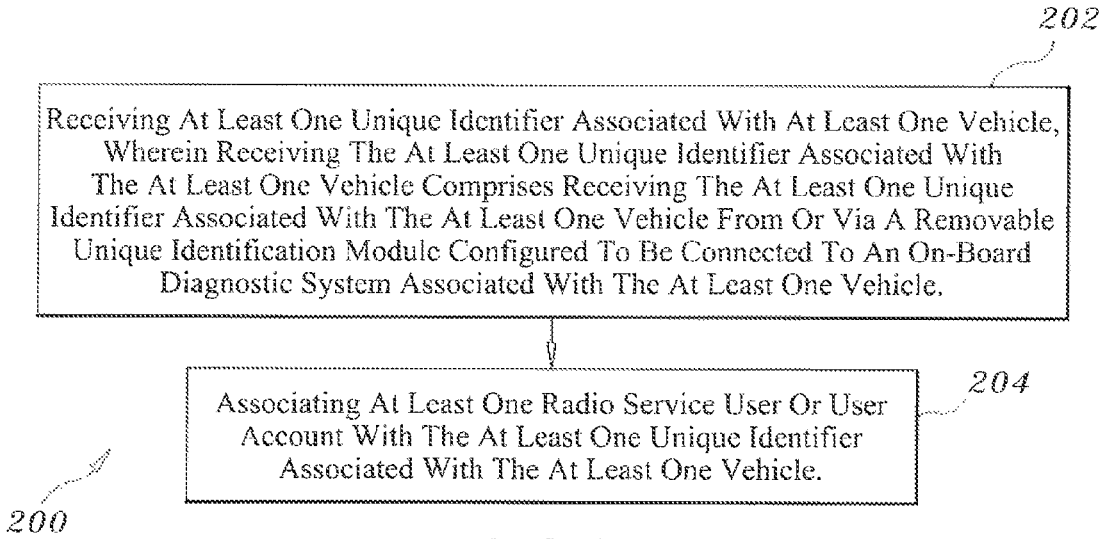
FIG. 2 shows a flow chart depicting a method in accordance with one embodiment.

Referring now to FIG. 2, a block diagram depicting a method 200 is shown in accordance with one embodiment, wherein method 200 may comprise receiving at least one unique identifier associated with at least one vehicle, wherein receiving the at least one unique identifier associated with the at least one vehicle comprises receiving the at least one unique identifier associated with the at least one vehicle from or via a removable unique identification module configured to be connected to an on-board diagnostic system associated with the at least one vehicle (block 202), and associating at least one radio service user or user account with the at least one unique identifier associated with the at least one vehicle (block 204).

In some embodiments, receiving at least one unique identifier comprises receiving at least one unique identifier from a RUIM via at least one radio service transceiver, wherein the radio service transceiver may be connected to, part of, or integrated with the at least one vehicle.

In some embodiments, the various steps of method 200 and elements used to carry out method 200 may comprise the various functions and features described above with reference to system 100.

In some embodiments, method 200 may comprise receiving the at least one unique identifier associated with the at least one vehicle via or from at least one radio transceiver positioned within the vehicle.

In some embodiments, method 200 may comprise receiving the at least one unique identifier comprises receiving the at least one unique identifier from the removable unique identification module via the at least one radio transceiver.

In some embodiments, the radio service comprises a satellite or internet radio service.

In some embodiments, the at least one unique identifier comprises a vehicle identification number associated with the at least one vehicle.

In some embodiments, method 200's may be steps carried out by computer executable instructions residing on a computer readable medium, which may include a non-transitory computer readable medium.

In some embodiments, method 200 may comprise presenting an option to select a customized radio service subscription on a user device, receiving a selection for a customized radio service subscription from the user device, and charging a user a fee for a time period when the customized radio service is used, wherein charging a user a fee for a time period comprises charging a user a fee on a per-use basis.

In some embodiments, presenting an option to select a customized radio service subscription may comprise presenting an option to select a customized radio service subscription via a communications network, such as the internet, via computing device or user device. In some embodiments, the option to select a customized radio service may comprise the option to select which types of content, stations, duration of service, number of receiving devices authorized to receive the content, and the like.

In some embodiments, receiving a selection may comprise receiving a selection via the communications network.

In some embodiments, the time period may comprise any time period, such as seconds, minutes, hours, days, months, years, and the like. In some embodiments, the pay-per-use model may comprise paying per use of the radio service, wherein a "use" may be defined as an individual event of accessing the radio service, accessing an individual radio station, and the like.

In some embodiments, the user device may comprise any type of user device, including, but not limited to, a computer, a laptop, a smartphone, a tablet PC, a radio service transceiver, a telephone, and the like.

Figure 3:
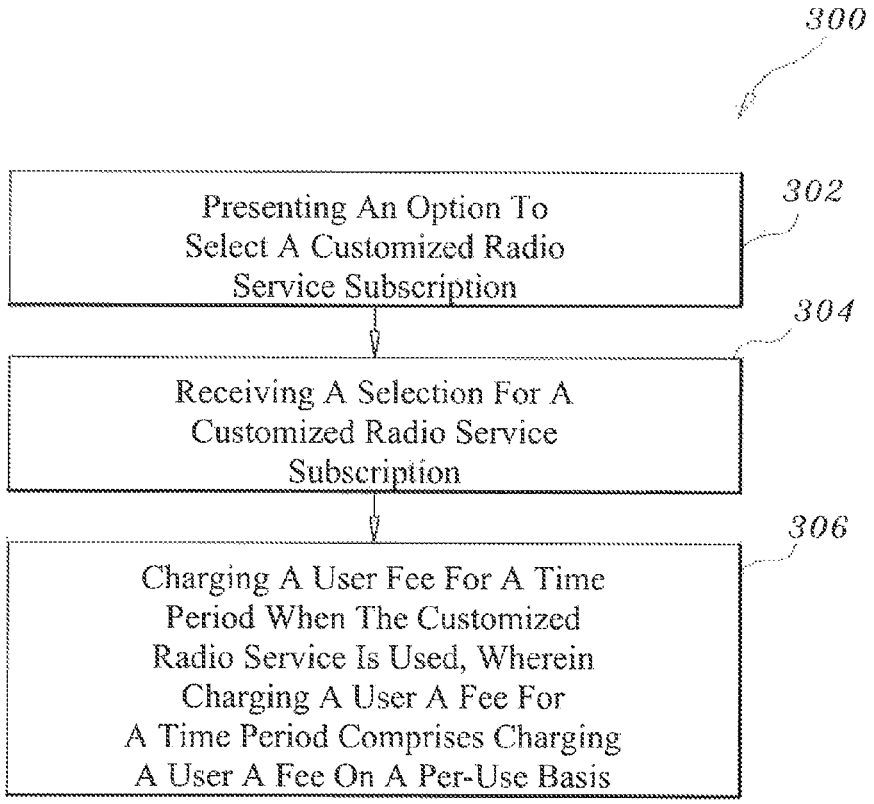
FIG. 3 shows a flow chart depicting a method in accordance with yet another embodiment.

Referring now to FIG. 3, a block diagram depicting a method 300 is shown in accordance with one embodiment, wherein method 300 may comprise presenting an option to select a customized radio service subscription (block 302), receiving a selection for a customized radio service subscription (block 304), and charging a user a fee for a time period when the customized radio service is used, wherein charging a user a fee for a time period comprises charging a user a fee on a per-use basis (block 306).

In some embodiments, presenting an option to select a customized radio service subscription may comprise presenting an option to select a customized radio service subscription via a communications network, such as a wide area communications network, such as a world wide web, internet, cellular network, and the like, via computing device (e.g. a user device). In some embodiments, the option to select a customized radio service may comprise the option to select which types of content, stations, duration of service, number of receiving devices authorized to receive the content, and the like.

In some embodiments, receiving a selection may comprise receiving a selection via the communications network.

In some embodiments, the time period may comprise any time period, such as seconds, minutes, hours, days, months, years, and the like. In some embodiments, the pay-per-use model may comprise paying per use of the radio service, wherein a "use" may be defined as an individual event of accessing the radio service, accessing an individual radio station, and the like.

In some embodiments, method 300 may comprise receiving at least one unique identifier associated with at least one vehicle associated with the user, wherein receiving the at least one unique identifier associated with the at least one vehicle comprises receiving the at least one unique identifier associated with the at least one vehicle from or via a removable unique identification module configured to be connected to an on-board diagnostic system associated with the at least one vehicle, and associating the user or a service account of the user with the at least one unique identifier associated with the at least one vehicle.

In some embodiments, the user device may comprise any type of user device, including, but not limited to, a computer, a laptop, a smartphone, a tablet PC, a radio service transceiver, a telephone, and the like.

In some embodiments, the various steps performed, and the elements used in carrying them out, may comprise any or all of those embodiments described above with references to system 100 and method 200.

In some embodiments, a non-transitory medium containing computer executable instructions may be provided, wherein the computer executable instructions may be configured to perform any or all of the steps or functions of system 100, and/or methods 200 and 300, and any embodiments thereof.

Hardware and Operating Environment

This section provides an overview of example hardware and the operating environments in conjunction with which embodiments of the inventive subject matter can be implemented. A software program may be launched from a computer readable medium in a computer-based system to execute the functions defined in the software program. Various programming languages may be employed to create software programs designed to implement the systems and methods disclosed herein. The programs may be structured in an object-orientated format using an object-oriented language such as Java or C++. Alternatively the programs may be structured in a procedure-oriented format using a procedural language, such as assembly or C. The software components may communicate using a number of mechanisms, such as application program interfaces, or inter-process communication techniques, including remote procedure calls. The teachings of various embodiments are not limited to any particular programming language or environment. Thus, other embodiments may be realized, as discussed regarding FIG. 4 below.

Figure 4:
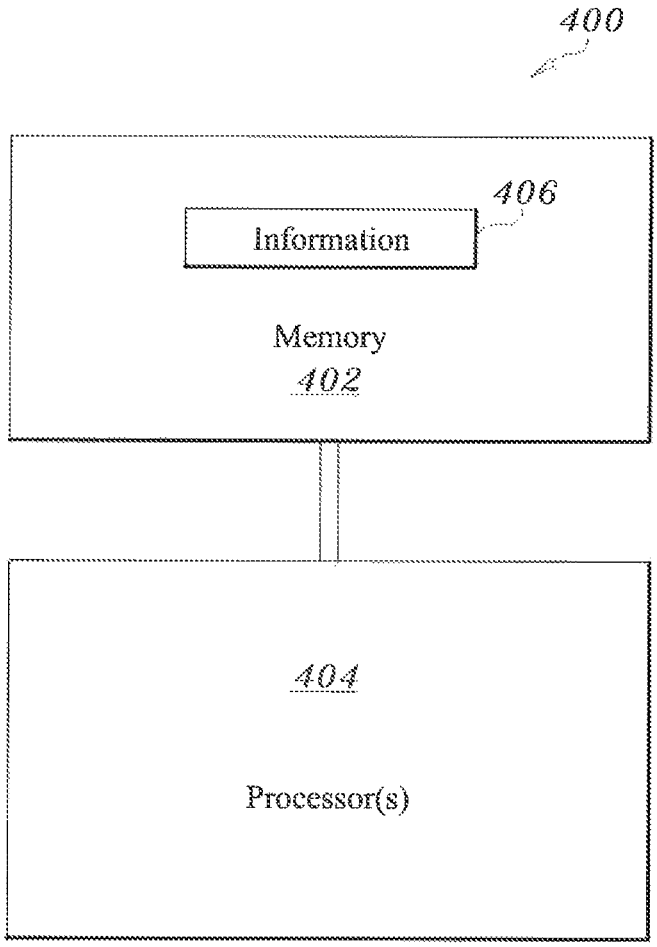
FIG. 4 shows a block diagram depicting an apparatus in accordance with one embodiment.

FIG. 4 is a block diagram representing an apparatus 400 according to various embodiments. Such embodiments may comprise a computer, a memory system, a magnetic or optical disk, some other storage device, or any type of electronic device or system. The apparatus 400 may include one or more processor(s) 404 coupled to a machine-accessible medium such as a memory 402 (e.g., a memory including electrical, optical, or electromagnetic elements). The medium may contain associated information 406 (e.g., computer program instructions, data, or both) which, when accessed, results in a machine (e.g., the processor(s) 404) performing the activities previously described herein.

The principles of the present disclosure may be applied to all types of computers, systems, and the like, include desktop computers, servers, notebook computers, personal digital assistants, microcomputers, and the like. However, the present disclosure may not be limited to the personal computer.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

The invention claimed is:

1. A system comprising:

at least one radio service transceiver positioned within a vehicle, wherein the vehicle comprises an on-board diagnostic system;

a removable unique identification module configured for connectivity to the vehicle's on-board diagnostic system, and configured for transmitting a unique identifier associated with the vehicle to the at least one radio service transceiver; and wherein the at least one radio service transceiver is configured to electronically communicate with the removable unique identification module.

2. The system of claim 1, wherein the removable unique identification module comprises a unique identifier associated with at least one user account.

3. The system of claim 1, wherein the removable unique identification module is configured to be connected to an on-board diagnostic port in the vehicle.

4. The system of claim 1, wherein the removable unique identification module is configured to communicate with the vehicle's on-board diagnostic system and receive a unique identifier associated with the vehicle.

5. The system of claim 4, wherein the at least one unique identifier comprises a vehicle identification number associated with the at least one vehicle.

6. The system of claim 1, wherein the at least one radio service transceiver is configured to transmit the at least one unique identifier associated with the vehicle to at least one radio service provider.

7. The system of claim 1, wherein the removable unique identification module is configured to receive power from an on-board diagnostic port.

8. The system of claim 1, wherein the removable unique identification module comprises a communications device configured to communicate with the at least one radio service transceiver.

9. A method comprising:

receiving at least one unique identifier associated with at least one vehicle, wherein receiving the at least one unique identifier associated with the at least one vehicle comprises receiving the at least one unique identifier associated with the at least one vehicle from or via a removable unique identification module, via the at least one radio transceiver, wherein the removable unique identification module is configured to be connected to an on-board diagnostic system associated within the at least one vehicle; and associating at least one radio service user or user account with the at least one unique identifier associated with the at least one vehicle.

10. The method of claim 9, comprising receiving the at least one unique identifier associated with the at least one vehicle via or from at least one radio transceiver positioned within the vehicle.

11. The method of claim 9, comprising:

presenting an option to select a customized radio service subscription on a user device;

receiving a selection for a customized radio service subscription from the user device; and charging a user a fee for a time period when the customized radio service is used, wherein charging a user a fee for a time period comprises charging a user a fee on a per-use basis.

12. The method of claim 9, wherein the at least one unique identifier comprises a vehicle identification number associated with the at least one vehicle.

13. A non-transitory computer readable medium containing computer executable instructions configured to:

receive at least one unique identifier associated with at least one vehicle, wherein receiving the at least one unique identifier associated with the at least one vehicle comprises receiving the at least one unique identifier associated with the at least one vehicle from or via a removable unique identification module, via the at least one radio transceiver, wherein the removable unique identification module is configured to be connected to an on-board diagnostic system associated with the at least one vehicle; and associate at least one radio service user or user account with the at least one unique identifier associated with the at least one vehicle.

14. The non-transitory computer readable medium of claim 13, wherein the computer executable instructions are configured to receive the at least one unique identifier associated with the at least one vehicle via or from at least one radio transceiver positioned within the vehicle.

15. The non-transitory computer readable medium of claim 14, wherein the at least one unique identifier comprises a vehicle identification number associated with the at least one vehicle.

* * * * *